United States Patent [19]

Dinger et al.

[11] 4,280,081

[45] Jul. 21, 1981

[54] MOTOR DRIVE SYSTEM WITH INERTIA COMPENSATION

[75] Inventors: Edward H. Dinger, Waynesboro; Allen M. Ritter, Rocky Mount, both of Va.

[73] Assignee: General Electric Company, Salem, Va.

[21] Appl. No.: 105,907

[22] Filed: Dec. 21, 1979

[51] Int. Cl.[3] ..... B65H 59/38

[52] U.S. Cl. ..... 318/6; 318/328; 318/331; 318/433; 242/75.51

[58] Field of Search ..... 318/6, 7, 310, 311, 318/312, 328, 331, 332, 333, 338, 342, 433, 434, 493, 503, 504, 506, 532; 242/75.5, 75.51

[56] References Cited

U.S. PATENT DOCUMENTS 2,874,917 2/1959 Pell ..... 242/75.51

*Primary Examiner*—Stanley J. Witkowski
*Assistant Examiner*—John W. Redman
*Attorney, Agent, or Firm*—Arnold E. Renner

[57] ABSTRACT

A motor drive system having a direct current, shunt motor utilized in a web coiling operation and operated in a tension control mode includes circuitry to automatically provide compensation for inertial effects of the drive and the web coil during periods of acceleration and deceleration.

22 Claims, 4 Drawing Figures

COMPARATOR (+ O −)
± CLAMP
ABSOLUTE MAGNITUDE CIRCUIT
dN_L/dt
N_L
I_F
|I_F|
K_1
K_2
I
−V

MOTOR DRIVE SYSTEM WITH INERTIA COMPENSATION

BACKGROUND OF THE INVENTION

The present invention relates generally to motor drive systems operable to control tension in a web coiling operation and more particularly to such systems which include compensation for inertial effects of the system when it is accelerating and decelerating.

In many industries such as paper making and metal rolling, one of the final operations is the winding of the web material into a coil or reel so that it may be easily transported for additional fabrication or processing. One of the most common motor drives used in web coiling operations employs the shunt wound, direct current (d.c.) motor having controlled excitation of both the armature and field windings of the motor. In these systems, tension in the web is controlled by controlling the torque supplied to the coiling reel. This torque control is normally achieved by controlling the armature winding current. In these systems, it is customary to include some form of compensation for system inertia so that the web is properly coiled and does not stretch or break when the system is accelerating or decelerating.

Two system inertias are known to be of primary importance. The first of these varies directly as the square of the ratio (R) of the radius of the coiled web material to the maximum radius of the final coil. The second inertia of concern is that occasioned by the rest of the moving parts of this system excepting the web material and this varies inversely with the square of the ratio R. In mathematical terms, the compensation to the armature current is expressed as:

$$I_{A\text{-}CO}=K_1R^2+K_2/R^2, \quad (1)$$

wherein, the terms $K_1$ and $K_2$ are system constants which, although are capable of being mathematically calculated, are normally derived by empirical methods for the particular system in question.

In a common prior art method, compensation for the inertias is achieved by a straightforward electrical application of the above formula. That is, the maximum radius is defined and then the instantaneous actual radius of the coil is determined from the relationship between the linear speed of the web material and the rotational speed of the coil or reel. This requires suitable speed measuring devices such as tachometers for each component; for example, one tachometer associated with the web feed rollers and another with the coil. Having derived the two relative speeds and with the knowledge of the two constants $K_1$ and $K_2$, the compensation armature current $I_{A\text{-}CO}$ is then derived using analog dividers, multipliers and adders in, as stated, a pure electrical implementation of formula (1).

This prior art system functions very well and provides very accurate compensation. It is also extremely expensive to properly implement. As indicated, two speed measuring devices are required and the analog circuitry to perform the indicated calculations all result in an expensive system, especially when the high quality components necessary for accurate computations and compensation are used.

SUMMARY OF THE INVENTION

It is, therefore, an object of the present invention to provide an accurate and relative inexpensive motor drive system with inertia compensation.

A further object is to provide, in a motor drive coiling system, compensation circuitry for inertial effects of the overall system.

It is another object to provide inertial compensation in a motor drive coiling system which provides acceptable accuracy at minimal cost.

An additional object is to provide an inexpensive, economical system for compensation for inertial effects during acceleration and deceleration, associated with the coiling of a web material.

The foregoing and other objects are achieved in accordance with the present invention by providing a d.c. shunt motor having separately excitable armature and field windings to drive or control the web coil. A first feedback loop responsive to the linear speed of the web material and the armature voltage of the motor is utilized to maintain the relationship between those two motor parameters fixed. Tension in the web is controlled through the control of the motor armature current and to the end there is provided a second feedback which compares a signal representative of the armature current with a reference value designating a desired web tension to effect primary control of tension within the web. A compensation circuit to compensate for inertial effects within the system during acceleration and deceleration employs the signal representative of the linear speed of the web in conjunction with a signal representative of the motor torque associated with the field winding. The speed signal is utilized to provide an indication of whether the system is accelerating, decelerating or remaining constant in speed while the torque signal which is employed along with empirically derived system constants to provide the actual compensation signal which is used to modify the basic armature current feedback control.

BRIEF DESCRIPTION OF THE DRAWING

While the present invention is particularly defined in the claims annexed to and forming a part of this specification, a better understanding can be had from the following description taken in conjunction with the accompanying drawing in which:

DETAILED DESCRIPTION

Figure 1:
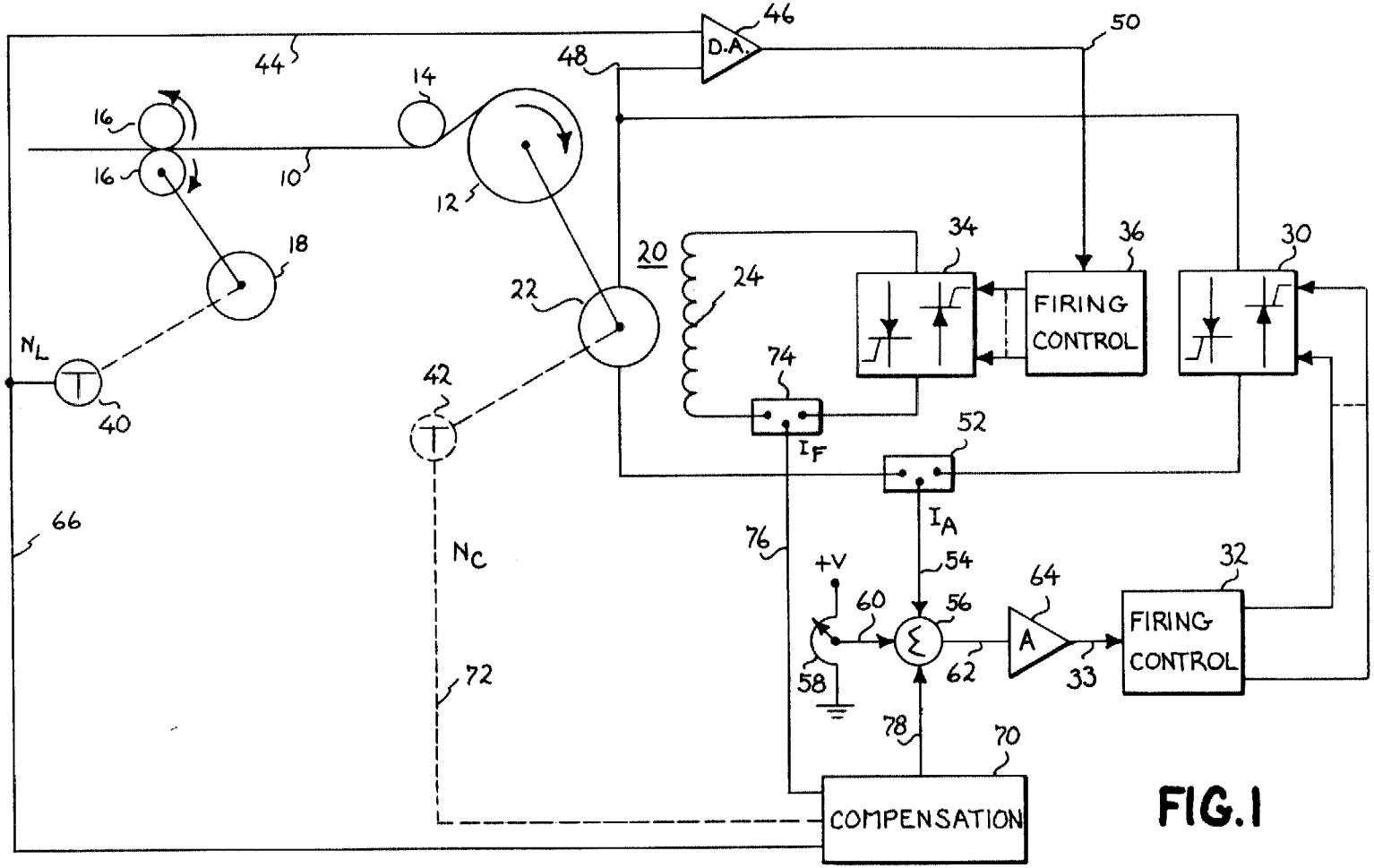
FIG. 1 is a schematic diagram illustrating the overall motor drive system in accordance with both the prior art and the present invention.

Reference is now made to FIG. 1 which shows the overall control system both in accordance with the prior art and, in the overall aspect, in accordance with the present invention. As shown, a web of material 10 is being coiled into a suitable reel or coil 12. An idler roll 14 is provided in contact with the web and the web is delivered to the coil 12 by a pair of drive rollers 16 powered by a suitable motor 18. Rotation of the coil 12 is achieved and controlled by a d.c. shunt motor indicated generally at 20 which motor has an armature winding 22 and a field winding 24. Power is supplied to the armature winding 22 from a suitable power conversion unit 30 which is controlled by a firing control 32 to thereby control the voltage and current supplied to the armature winding 22. While the exact nature of the units 30 and 32 are not important to the present invention, the power conversion unit 30 would typically be a six thyristor, three phase a.c. to d.c. rectifier which is operated in the well-known phase control mode. This type of unit receives firing pulses for the individual rectifiers from a suitable phase control (e.g., firing control 32) in accordance with the magnitude of an input signal supplied thereto by way of line 33. The derivation of the signal on line 33 will be discussed later.

In a similar manner, electrical power is supplied to the field winding 24 from a suitable source such as a power conversion unit 34 which receives control signals from a firing control 36. Power conversion unit 34 and control 36 may be similar to those described with respect to 30 and 32, respectively. Firing control 36 receives an input signal to control the power to the field winding 24 by way of a line 50.

The signal on line 50 is the result of a first control feedback loop which serves to control the current supplied to the field winding by way of units 34 and 36. To this end there is provided a suitable means for determining the linear speed of the web material 10 which in FIG. 1 is illustrated as a tachometer 40 connected to the motor 18 driving the drive rollers 16. The output of tachometer 40, a signal designated $N_L$, is in the illustrated embodiment a voltage signal having a magnitude proportional to the rotational speed of the motor 18 and, hence, the linear speed of the web 10. Signal $N_L$ is supplied, by way of line 44, as one input to a differential amplifier 46. The second input to the differential amplifier 46, via line 48, is a signal proportional to the armature voltage ($V_A$) of the armature winding 22 of the motor 20. The output of the differential amplifier 46 is the signal on line 50.

The purpose of this first feedback loop is to hold the armature voltage proportional to the linear speed of the web at a fixed relationship. The reason for this may be understood from the following. If it is desired to hold the tension in the web constant, then at a constant web speed there is a fixed demand for mechanical horsepower within the system. From this, the electrical horsepower to be supplied to the motor 20 can be predicted which in the first approximation will be equal to the mechanical horsepower required. With the desire to have a constant electrical horsepower, it is, therefore, required that the product of the armature voltage and the armature current (i.e., $V_A \cdot I_A$) remain constant. As such, if $V_A$ is held proportional to $N_L$ and $I_A$ is held proportional to desired tension, then the relationship is satisfied. To do this, two controls are needed. Since a single control supplying the armature winding 22 is not capable of independently controlling both $I_A$ and $V_A$, and since if armature current is to be utilized to control tension the logical choice is to use the unit 30, it is necessary to control the armature voltage by way of the field current which, in turn, controls the field flux ($\psi_F$). This is possible since, as is well known in the motor art, when the motor is moving, varying the field current varies the armature voltage in accordance with the first order approximation equation (ignoring $I^2R$ losses):

$$V_A = \psi_F(K_V)RPM, \quad (2)$$

wherein $K_V$ is a motor constant and RPM is the speed of the motor in revolutions per minute.

A second feedback loop shown in FIG. 1 is that which controls the armature current to control the tension within the web material 10. A shunt 52 is provided in the supply lines from the unit 30 to provide on the armature 22 to output signal on line 54 which is proportional to the armature current. This signal forms one input to a summing junction 56 which receives a second input from a suitable desired tension reference source indicated as a potentiometer 58 having its wiper arm connected to the summing junction by way of line 60. Potentiometer 58 is connected between a source of positive potential (+V) and ground and is, in the illustrated embodiment, designed to be manually set in accordance with the desired level of tension. Other ways of developing this reference signal may, of course, be employed. Ignoring for a moment the third input to summing junction 56, it is seen that the two signals furnished to junction 56 by way of lines 54 and 60 are summed to provide an output on line 68 which is scaled by a suitable sealing amplifier 64 to provide the signal on line 33 to the firing control 32.

The remaining depiction in FIG. 1 is that which relates to the inertia compensation for the system. In accordance with the prior art as earlier discussed, the inertia compensation utilizes two signals. The first of these signals is that which is proportional to the linear speed of the web; i.e., the signal $N_L$ from the tachometer 40. The second signal utilized is a signal which is proportional to the coil speed. In FIG. 1 this signal is designated $N_C$ and is shown as emanating from a tachometer 42 and furnished to line 72. The dashed-line depiction of the tachometer 42 and its associated line 72 is intended to illustrate that these elements are present in the prior art system but not in the present invention system as will be discussed later. In the prior art case, the two signals $N_L$ and $N_C$ are applied to a suitable compensation circuit, illustrated by block 70, which outputs a signal via line 78 to the summing junction 56 to thereby modify the comparison of the other two signals on lines 54 and 60. In the prior art system, either of the two signals $N_L$ or $N_C$ could be utilized to determine whether the system is in an acceleration or deceleration mode and the compensation signal to be provided on line 78 is the result of the computation eariler described with respect to the formula (1).

Figure 2:
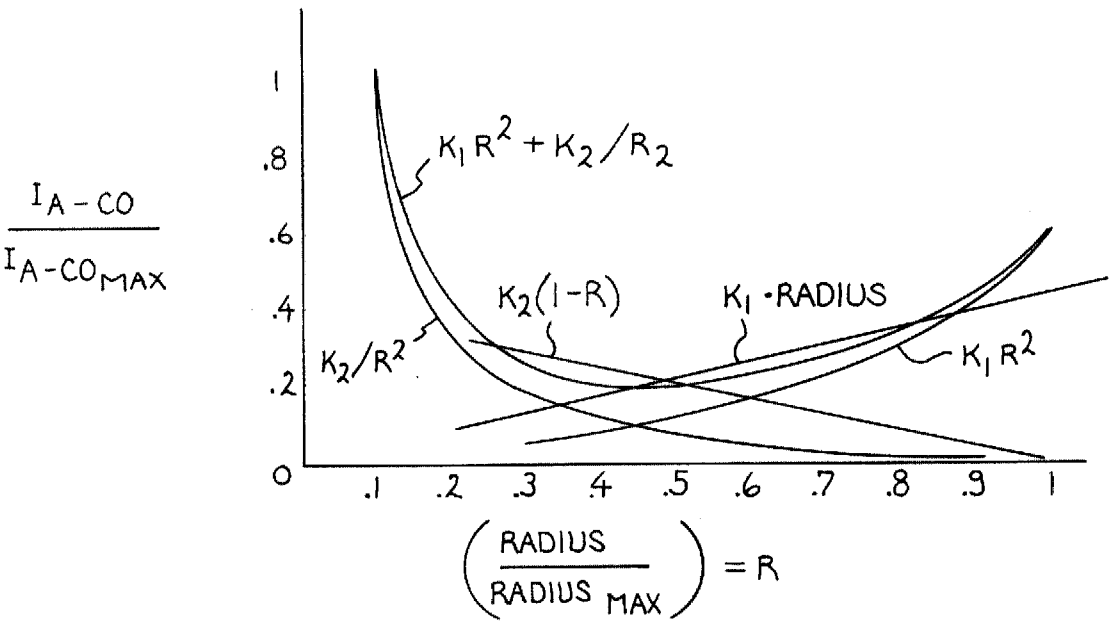
FIG. 2 shows graphs helpful in understanding the present invention.

FIG. 2 depicts graphically, inter alia, the result of the formula (1) computation. In FIG. 2, there is plotted as the ordinate the ratio of the instantaneous compensating current ($I_{A\text{-}CO}$) to the maximum compensating current ($I_{A\text{-}CO_{max}}$). The abscissa is in terms of the ratio (R) of the instantaneous radius to the maximum radius of the coil. In accordance with formula (1) the two lines designated, respectively, as $K_1R^2$ and $K_2/R^2$ are added to produce the line $K_1R^2+K_2/R^2$ which is the theoretical and desired compensation for inertia within the system. The remaining showing of FIG. 2 relates to the compensation provided by the present invention and will be discussed later.

Returning now to FIG. 1, the overall system therein shown is also applicable to the present invention, subject to the modifications to be discussed. With respect to the present invention, the compensation circuitry shown generally at 70 receives the linear speed signal $N_L$ from the tachometer 40 by way of line 66 as before.

The present invention does not, however, use the reel speed signal $N_C$ and thus tachometer 42 would not be required. There is, however, included in the present invention the use of a signal proportional to the field current ($I_F$) which is shown as being derived by way of a suitable shunt included within the lines supplying the field winding 24 from the conversion unit 34. Shunt 74 supplies a signal via line 76 to the compensation circuit which is proportional to the field current. In accordance with the present invention, the compensation circuit 70 utilizes the $N_L$ and $I_F$ signals to provide, on line 78, an armature current compensating signal to maintain constant tension in the web 10 during periods of acceleration and deceleration.

Figures 3, 4:
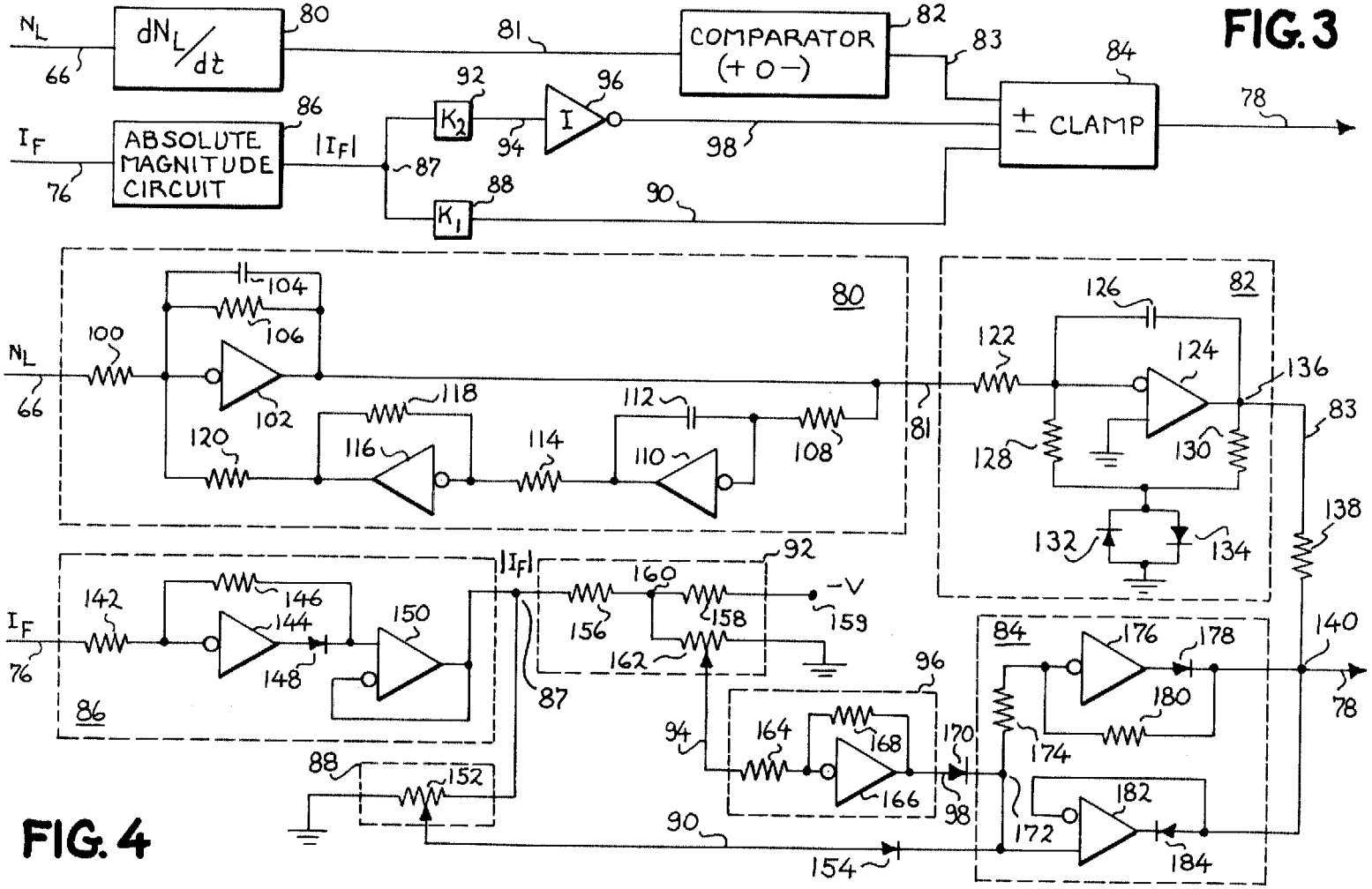
FIG. 3 is a block diagram illustrating the compensation scheme of the present invention in its preferred embodiment; and, FIG. 4 is a detailed schematic diagram showing one possible implementation of the circuitry represented by the block diagram of FIG. 3.

The nature of the compensation circuit in accordance with the present invention is illustrated in FIGS. 3 and 4. Before beginning a description of those figures, however, it is believed desirable to first explain briefly theory involving the use of the field current signal $I_F$. In accordance with the prior art and with established physical principles, it is apparent that the compensation required to maintain constant web tension will be a function of the mass of the coil material which is, of course, a function of its radius. It will be remembered from equation (2) that the motor armature voltage ($V_A$) is proportional to the field flux and the motor speed. It will also be remembered that the top control loop including the differential amplifier 46 (FIG. 1 ) serves to hold the armature voltage ($V_A$) in a fixed relationship with respect to the web speed. Since the linear speed of the web and the coil rotational speed are directly proportional as a function of the coil radius, it then follows that the field flux is proportional, in a fixed relationship, to the radius of the coil 12. It is also to be understood that, since compensation for inertial effects must result in a change in torque applied to the coil 12 and that since the torque applied to the reel is a function of the motor current, the field current will also be a fixed relationship with respect to that torque.

With the foregoing understandings, reference is now made to FIGS. 3 and 4 which illustrate the compensation circuit in accordance with the present invention. Referencing first FIG. 3 which shows the compensation circuit of the present invention in a major block diagram form, it is seen that the linear web speed signal $N_L$ is applied to a differentiating circuit 80 which takes the differential of the $N_L$ signal and provides on an output line 81 a signal indicative of whether the web is accelerating, decelerating or remaining constant in speed. This signal on line 81 is applied to a comparator or digitalizing circuit 82 which will provide, on its output line 83, a signal having either a high positive value, a high negative value or a zero value depending upon whether the reel 12 is accelerating, decelerating or running at constant speed. The signal on line 82 serves as one input to a ±clamp circuit 84 the output of which (line 78) is applied to the summing junction 56 (see FIG. 1). The ±clamp circuit 84 determines which of two clamp limit signals will be utilized as the signal on line 78. The clamp limit signals serve as the other two inputs to the circuit 84 and are to be described.

The second input to the compensation circuit 70 depicted in block form in FIG. 2 is the field current signal ($I_F$). This signal forms an input to an absolute magnitude circuit 86 which provides an output signal proportional to the absolute magnitude of that current signal and this absolute magnitude signal forms one input to two proportioning circuits or multipliers shown at 88 and 92. The output of the circuit 88, which appears on line 90, will be the signal which is a function of both the proportionality constant $K_1$ and the absolute magnitude of the field current. The second multiplier or proportionality circuit 92 provides on its output line 94 a signal which is a function of the proportionality constant $K_2$ and the field current signal. The signal on line 94 is supplied to a suitable inverter 96 such that the output of that inverter (line 98) is the inversion of the output of the circuit 92. The two signals on lines 90 and 98 are the clamp limit signals earlier mentioned and are applied to the ±clamp circuit 84 which utilizes these signals in conjunction with the signal from the comparator 82 to output the compensation signal on line 78. As will be better understood with respect to FIG. 4, the two signals 90 and on lines 98 determine the magnitude of the signal on line 78 while the comparator output on line 83 determines the relative polarity of that signal. Thus, the signal on line 78 will have a magnitude and a relative polarity and serves as an inertia compensation in a manner similar to that in the prior art. Similarly, with respect to the prior art, the two proportionality constants or multiplication factors $K_1$ and $K_2$ are system constants which may be empirically derived for the particular system in question and which are constants proportional, respectively, to the inertia of the web material being wound and the inertia of the rest of the moving parts of the system. It is, of course, to be expressly understood that while these constants are of the same nature of those of the prior art, they would not necessarily be of the same value.

FIG. 4 illustrates one possible way of implementing the compensation circuitry of the present invention as is shown in block form in FIG. 3. In FIG. 4 the $N_L$ signal on line 66 is applied to the differentiating circuit 80. As illustrated, the $N_L$ signal is applied, via input resistor 100, to the inverting input of an operational amplifier 102 having the parallel combination of a capacitor 104 and a resistor 106 connected between its output and input. Operational amplifier 102 operates as a high gain inverting amplifier. A second feedback path between its output and its input includes a resistor 108 which applies the output signal from the amplifier 102 to the inverting input of an operational amplifier 110 having capacitor 112 connected thereacross. Amplifier 110 as thus connected provides an integration function and the output of this amplifier, the integral of the output of the amplifier 102, is applied by way of a suitable input resistor 114 to the inverting input of an inverting operational amplifier 116 having a resistor 118 connected between its output and its input. The output of this inverter is applied by way of resistor 120 to the input of the amplifier 102. The output of circuit 80, appearing on line 81, is the differential of the $N_L$ input on line 66. That this is true is evident from the fact that the integrated output of the amplifier is balanced with the input and, therefore, the output of the amplifier must of necessity be the differential.

This differential signal is applied, via line 81, to the comparator or digitalizing circuit 82 which includes an input resistor 122 connecting the signal on line 81 to the inverting input of an operational amplifier 124 the non-inverting input of which is connected to ground. A first feedback path including a capacitor 126 is connected between the output of the amplifier 124 and its inverting input and a second feedback path thus also connected includes a pair of series connected resistors 128 and 130. The junction of the resistors 128 and 130 is further connected to ground by way of a pair of antiparallel connected diodes 132 and 134. This digitalizing circuit provides, at its output node 136, a substantially zero voltage signal when the input as seen by its inverting input is at a voltage less than the voltage drop across a one of the diodes 132 and 134. When the voltage on line 81 is of a higher magnitude, circuit 82 will put out a large positive or negative signal depending upon the polarity of the signal on line 81. In the specific circuitry illustrated, when the system is accelerating a negative signal will appear on line 81 resulting in a large positive output signal at node 136. Conversely, when the system is decelerating, the signal on line 81 will be positive resulting in a large negative output signal at node 136. The signal at node 136 is applied by way of a suitable resistor 138 to node 140 which forms the origin of line 78; i.e., the inertia compensation signal.

Still with reference to FIG. 4, it is seen that the field current signal $I_F$ on line 76 serves as an input via resistor 142 to the inverting input of an operational amplifier 144, the output of which is connected by way of a diode 148 and a resistor 146 to its input. The cathode of diode 148 is connected to the noninverting input of an operational amplifier 150 which has its output connected to its inverting input. This is a standard type absolute magnitude circuit such that there appears at the output of the circuit 86, at node 87, a signal which is proportional to the absolute magnitude of the field current; that is, $|I_F|$. Node 87 is connected by way of the multiplier or proportionality circuit 88 to ground. In accordance with the preferred embodiment of the present invention, the proportionality circuit or multiplier 88 is comprised merely of a potentiometer 152, the adjustment of which is empirically set to achieve the proportionality constant $K_1$. The output of the circuit 88 (on line 90) is, therefore, a clamp limit signal having a value equal to $K_1(|I_F|)$.

The signal at node 87 also forms the input to the second proportionality circuit 92. In this instance, node 87 is connected by way of a pair of series connected resistors 156 and 158 to a terminal 159 to which there is applied a voltage $(-V)$ which is equal in magnitude but opposite in polarity to the maximum signal which can appear at node 87. Thus, when the field current is at its maximum value, the voltage at junction 160 between the two resistors 156 and 168 will be zero. Junction 160 is connected by way of a second potentiometer 162 to ground with potentiometer 162 being set to provide the second proportionality constant $K_2$. There thus appears at the output of the circuit 92 (line 94) a signal which is equal to $K_2(|I_F|-V)$. This signal is in turn applied to the inverter circuit 96 which includes an input resistor 164 connected to the inverting input of an operational amplifier 166 having a feedback resistor 168 connected between its output and input. The output of the inverter 96 (line 98) is, therefore, the inversion of the input signal on line 94, is the second clamp limit signal and is equal, in accordance with the circuit illustrated, to: $K_2(V-|I_F|)$.

The first and second clamp limit signals on lines 90 and 98, respectively, are applied by respective diodes 154 and 170 to an input node 172 of the ±clamp circuit 84. Node 172 is connected via a resistor 174 to the inverting input of an operational amplifier 176 the output of which is connected to its input by way of a diode 178 and a resistor 180. The cathode of diode 178 is further connected to the output node 140. Node 172 is further connected to the noninverting input of an operational amplifier 182 which has its output connected by way of a reverse poled diode 184 to its inverting input with the anode of diode 184 further being connected to the output node 140.

The operation of the ±clamp circuit 84 is substantially as follows. It will be first noted that because diodes 154 and 170 are connected to the common node 172 that this node will always be at the higher of the positive values of the two clamp limit circuits on lines 90 and 98. That is, it will be the higher of the two values $K_1(|I_F|)$ and $K_2(V-|I_F|)$. Now, let it be first assumed that the system is in a steady speed mode of operation such that, in accordance with the earlier description, the signal at node 136 of the comparator circuit 82 will be approximately zero. In this situation, node 140 will be at approximately zero volts and thus the inverting input to amplifier 182 will be at approximately zero volts. Since the voltage at node 172 is positive and hence greater than the inverting input signal, amplifier 182 will attempt to output a positive signal which will back bias diode 184. Hence, amplifier 182 does not participate in the voltage at node 140. In this situation the positive signal at node 172 is also applied to the inverting input of amplifier 176 which tends to force a negative output from that amplifier to back bias diode 178 preventing this amplifier from participating. The voltage at 140 is, therefore, essentially zero and thus, with respect to FIG. 1, no compensation signal is provided to the summing junction 56. This is in accordance with the desired operation since at this time, with a zero output at node 136 of the circuit 82, the system is not accelerating or decelerating.

Let it now be assumed that node 136 acquires a very positive voltage as will be the case when the system is accelerating. With a positive voltage at node 136, node 140 will tend to go positive such that the voltage at node 140 will tend to be greater than the voltage at node 172. When these two voltages are equal, the inverting input at amplifier 182 is equal in voltage to that at node 172 and amplifier 182 will thus output a negative signal to forward bias diode 184 and thus clamp the voltage at node 140 to the value of the signal at node 172. In this situation, since the signal at 172 is positive as is the signal at node 140, the input to amplifier 176 is positive resulting in a negative output therefrom which back biases diode 178. Thus, in this instance amplifier 176 does not participate and the voltage at 140 is, therefore, clamped by amplifier 182 to the value at node 172 which as was earlier stated is at the higher voltage level of the two clamp limit signals on lines 90 and 98.

The third possible situation which exists is that which occurs when the system is in a deceleration mode of operation. In accordance with the earlier description, the signal at node 136 will now be at a high negative voltage. This high negative voltage will cause node 140 to tend to go negative. When the absolute value of the signal at node 140 is equal to the absolute value of that at node 172, amplifier 176 will provide an output voltage which forward biases diode 178 to hold the absolute value of 140 to not less than that of the absolute value of node 172. Since at this time the voltage at node 140 is negative and the voltage at node 172 is positive, the output of amplifier 182 will be positive and will back bias the diode 184. Here, the amplifier 182 does not play a part of the circuit. Thus, it is seen that there is provided a signal at node 140, the inertia compensation signal, which when the system is constant in speed is zero in value but which when the system is accelerating will provide a relatively positive output signal having a voltage magnitude determined by the higher of the two clamp limit signals and which, when the system decelerates will have a relatively negative voltage of a magnitude determined by the higher of the two clamp limit signals.

The function of the circuitry of the present invention is pictorially shown in FIG. 2 which further compares the operation of the present invention with that of the prior art. Before looking at FIG. 2, however, certain proportionalities earlier established need to be reiterated so that a logical comparison between the present invention and the prior art can be made and so that the designations on FIG. 2 are in accordance with the preceding description of the implementation of the present invention. It will be remembered that it was earlier shown that field current was proportional to the coil radius. Thus, the first clamp limit signal defined as having a value proportional to $K_1(|I_F|)$ can also be defined in a more generic form as having a value proportional to $K_1$. Radius (radius of the coil). It will also be remembered that the voltage (−V) at terminal 159 (FIG. 4) was stated to have an absolute value equal to that representing the field current at the maximum radius of the coil (i.e., the signal at node 87 of FIG. 4). Thus, the expression $K_2(V-|I_F|)$ may be written in the more generic terms of coil radius as $K_2(1-R)$ wherein, in accordance with the earlier description, $R=\text{Radius}/\text{Radius}_{max}$.

Referencing now FIG. 2, in addition to those lines discussed earlier with respect to the prior art, included are two additional lines labeled, respectively, $K_1$. Radius and $K_2(1-R)$. These two lines are graphical representations of the two clamp limit signals and it is seen that these are two linearly varying functions. The first increases with an increase of the radius of the coil and a second decreases with an increase in the radius of the coil. It is further to be noted that although only one such line is drawn for each function there is, in practicality, a series of such lines the slopes of which are respectively determined by the proportionality or inertia constants $K_1$ and $K_2$. Within the region shown, the two lines closely approximate the summation line of the prior art description. While these lines obviously lack the accuracy of that earlier line, it is evident that in most instances these lines closely approximate the ideal and the compensation provided is adequate and is achieved in a very economical manner. One further point to be noted is that the line $K_2(1-R)$ does not extend beyond a radius ratio of about 0.2. This does not, in most instances, represent a serious defect since in most coiling operations there is a mandrel about which coiling is started. As such, no actual coiling of material is done below ratios of this range.

Thus, it is seen that there has been provided a relatively simple and inexpensive circuitry for providing inertia compensation in a d.c. shunt motor coiling system which closely approximates the ideal mathematical desired compensation.

While there has been shown and described what is at present considered to be the preferred embodiment of the present invention, modifications thereto will readily occur to those skilled in the art. For example, the precise circuitry shown in FIG. 4 is only one means of implementation and those skilled in the art could readily provide other forms of implementation to produce the same overall result. It is not desired, therefore, that the invention be limited to the specific arrangements shown and described and it is intended to cover in the appended claims all such modifications as fall within the true spirit and scope of the invention.

What is claimed is:

1. A motor control system for use with a d.c. shunt motor, having separately excitable armature and field windings, operable to wind a web of material into a coil comprising:

(a) a first variable voltage source for supplying electrical power to said field winding;

(b) a second variable voltage source for supplying electrical power to said armature winding;

(c) means to sense the linear speed of said web and to provide a speed feedback signal proportional thereto;

(d) means to provide a signal proportional to the armature voltage of said motor;

(e) means responsive to said speed feedback signal and said armature voltage signal to provide a control signal for said first variable voltage source whereby the voltage supplied to said field winding is controlled to thereby maintain a prescribed relationship between web material speed and armature voltage;

(f) reference means for providing a reference signal proportional to a desired level of operation of said motor;

(g) feedback means for providing a current feedback signal proportional to the current in said armature winding;

(h) combining means for combining said reference signal, said current feedback signal and an inertia compensation signal to develop a control signal for controlling the operation of said second variable voltage to thereby control the electrical power supplied to said armature winding;

(i) means for generating said inertia compensation signal comprising:

(1) means responsive to said speed feedback signal for generating a modifying signal having distinct values respectively representing whether said web material is accelerating, decelerating or remaining constant in speed;

(2) means to provide an additional feedback signal proportional to the extant radius of the web material coil radius; and, (3) means responsive to said additional feedback signal for generating first and second clamp limit signals, said first clamp limit signal having values which increase with an increase in web coil radius and said second clamp limit signal having values which decrease with an increase in said web coil radius; and, (j) clamp means for gating said inertia compensation signal to said combining means as a function of the state of said modifying signal and the value of the larger of the first and second clamp limit signals.

2. The invention in accordance with claim 1 wherein said means responsive to said speed feedback signal for generating a modifying signal comprises:

(a) differentiating means to develop an output signal indicative of whether said web is accelerating, decelerating or constant in speed; and, (b) comparator means responsive to said output signal to provide said modifying signal.

3. The invention in accordance with claim 1 wherein said means responsive to said speed feedback signal for generating a modifying signal comprises:

(a) differentiating means to develop an output signal indicative of whether said web is accelerating, decelerating or constant in speed; and, (b) comparator means responsive to said output signal, said comparator means generating said modifying signal having a substantially zero value if the web speed is constant, having a fixed magnitude in excess of zero value and a first polarity relative to said zero value if said web is accelerating, and having a fixed magnitude and a second relative polarity if said web is decelerating.

4. The invention in accordance with claim 1 wherein said means to provide said additional feedback signal includes means to develop said additional feedback signal proportional to the torque developed by said field winding.

5. The invention in accordance with claim 1 wherein said means to provide said additional feedback signal includes means responsive to the current furnished to said field winding.

6. The invention in accordance with claim 1 wherein said means responsive to said additional feedback signal comprises:

(a) means to provide an absolute signal proportional to the absolute magnitude of said additional feedback signal;

(b) first proportioning means exhibiting a first proportionality constant and responsive to said absolute signal to develop said first clamp limit signal; and, (c) second proportioning means exhibiting a second proportionality constant and responsive to said absolute signal to develop said second clamp limit signal.

7. The invention in accordanc with claim 6 wherein said first and second proportioning means each comprises an adjustable potentiometer.

8. The invention in accordance with claim 5 wherein said menas responsive to said additional feedback signal comprises:

(a) means to provide an absolute signal proportional to the absolute magnitude of the current furnished to said field winding;

(b) first multiplying means exhibiting a first multiplication constant and responsive to said absolute signal to develop said first clamp limit signal; and, (c) second multiplying means exhibiting a second multiplication constant and responsive to said absolute signal to develop said second clamp limit signal.

9. The invention in accordance with claim 8 wherein said first and second multiplying means each comprises an adjustable potentiometer.

10. The invention in accordance with claim 6 wherein said first and second multiplying means each comprises an adjustable potentiometer, said first potentiometer adjusted to provide said first clamp limit signal of a value ($C_1$) defined by the equation:

$$C_1 = K_1 \cdot \text{Radius, and}$$

said second potentiometer is adjusted to provide said second clamp limit signal of a value ($C_2$) defined by the equation:

$$C_2 = K_2(l - R)$$

wherein, $K_1$ = constant proportional to inertia of web being coiled, $K_2$ = a constant proportional to inertia of said system excluding the web being coiled, Radius = instantaneous radius of wound web coil, R = ratio of the instantaneous radius of the wound web coil to the maximum radius of the coil to be wound.

11. The invention in accordance with claim 8 wherein said first and second multiplying means each comprises an adjustable potentiometer, said first potentiometer adjusted to provide said first clamp limit signal of a value ($C_1$) defined by the equation:

$$C_1 = R_1 \cdot \text{Radius, and}$$

said second potentiometer is adjusted to provide said second clamp limit signal of a value ($C_2$) defined by the equation:

$$C_2 = K_2(l - R)$$

wherein, $K_1$ = constant proportional to inertia of web being coiled, $K_2$ = a constant proportional to inertia of said system excluding the web being coiled, Radius = instantaneous radius of wound web coil, R = ratio of the instantaneous radius of the wound web coil to the maximum radius of the coil to be wound.

12. An inertia compensation scheme for use with a motor drive utilized to wind a web of material into a coil, said drive including a d.c. shunt motor having separately excitable armature and field windings and further including individually controllable power supplies for respectively furnishing electric current and voltage to said armature and field windings in response to individual control signals supplied to said power supplies, said inertia compensation scheme comprising:

(a) means to provide a first feedback signal proportional to the linear speed of said web;

(b) means to provide a second feedback signal proportional to the instantaneous radius of the web coil as a function of the field winding current;

(c) means responsive to said first feedback signal to provide a modifying signal having a first preset value if said web is accelerating in speed, a second preset value if said web is decelerating in speed and a third preset value if the web speed is constant;

(d) static electrical means responsive to said second feedback signal to develop first and second clamp limit signals, said first clamp limit signal having values which increase with an increase in the radius of a web coil and said second clamp limit signal having a value which decreases with an increase in the radius of said web coils; and, (e) clamp means providing a compensation signal to the power supply associated with said armature winding to thereby effect a change in the voltage supplied to that winding, said clamp means responsive to said modifying signal and to said first and second clamp limit signals to develop said compensating signals as a function of the state of said modifying signal and the value of the larger of said first and second clamp limit signals.

13. The invention in accordance with claim 12 wherein said means responsive to said first feedback signal comprises:

(a) differentiating means to develop an output signal indicative of whether said web is accelerating, decelerating or constant in speed; and, (b) comparator means responsive to said output signal to provide said modifying signal.

14. The invention in accordance with claim 12 wherein said means responsive to said first feedback signal comprises:

(a) differentiating means to develop an output signal indicative of whether said web is accelerating, decelerating or constant in speed; and, (b) comparator means responsive to said output signal, said comparator means generating said modifying signal having a substantially zero value if the web speed is constant, having a fixed magnitude in excess of zero value and a first polarity relative to said zero value if said web is accelerating, and having the fixed magnitude and a second relative polarity if said web is decelerating.

15. The invention in accordance with claim 12 wherein said means responsive to said second feedback signal includes means to develop said second feedback signal proportional to the torque developed by said field winding.

16. The invention in accordance with claim 12 wherein said means to provide said second feedback signal includes means responsive to the current furnished to said field winding.

17. The invention in accordance with claim 12 wherein said means responsive to said second feedback signal comprises:

(a) means to provide an absolute signal proportional to the absolute magnitude of said second feedback signal;

(b) first proportioning means exhibiting a first proportionality constant and responsive to said absolute signal to develop said first clamp limit signal; and, (c) second proportioning means exhibiting a second proportionality constant and responsive to said absolute signal to develop said second clamp limit signal.

18. The invention in accordance with claim 17 wherein said first and second proportioning means each comprises an adjustable potentiometer.

19. The invention in accordance with claim 16 wherein said means responsive to said second feedback signal comprises:

(a) means to provide an absolute signal proportional to the absolute magnitude of the current furnished to said field winding;

(b) first multiplying means exhibiting a first multiplication constant and responsive to said absolute signal to develop said first clamp limit signal; and, (c) second multiplying means exhibiting a second multiplication constant and responsive to said absolute signal to develop said second clamp limit signal.

20. The invention in accordance with claim 19 wherein said first and second multiplying means each comprises an adjustable potentiometer.

21. The invention in accordance with claim 17 wherein said first and second proportioning means each comprises an adjustable potentiometer, said first potentiometer adjusted to provide said first clamp limit signal of a value ($C_1$) defined by the equation:

$$C_1 = K_1 \cdot \text{Radius, and}$$

said second potentiometer is adjusted to provide said second clamp limit signal of a value ($C_2$) defined by the equation:

$$C_2 = K_2(l - R)$$

wherein, $K_1$ = constant proportional to inertia of web being coiled, $K_2$ = a constant proportional to inertia of said system excluding the web being coiled, Radius = instantaneous radius of wound web coil, R = ratio of the instantaneous radius of the wound web coil to the maximum radius of the coil to be wound.

22. The invention in accordance with claim 19 wherein said first and second multiplying means each comprises an adjustable potentiometer, said first potentiometer adjusted to provide said first clamp limit signal of a value ($C_1$) defined by the equation:

$$C_1 = K_1 \cdot \text{Radius, and}$$

said second potentiometer is adjusted to provide said second clamp limit signal of a value ($C_2$) defined by the equation:

$$C_2 = K_2(l - R)$$

wherein, $K_1$ = constant proportional to inertia of web being coiled, $K_2$ = a constant proportional to inertia of said system excluding the web being coiled, Radius = radius of wound web coil, R = ratio of the instantaneous radius of the wound web coil to the maximum radius of the coil to be wound.

* * * * *